US009276360B2

(12) United States Patent
McRae

(10) Patent No.: US 9,276,360 B2
(45) Date of Patent: Mar. 1, 2016

(54) APPARATUS AND METHOD FOR PROVIDING A RESISTIVE SHUNT WITHIN A LIGHT STRING

(71) Applicant: Michael M McRae, Ormnod Beach, FL (US)

(72) Inventor: Michael M McRae, Ormnod Beach, FL (US)

(73) Assignee: National Christmas Products, Cranford, NJ (US)

( * ) Notice: Subject to any disclaimer, the term of this patent is extended or adjusted under 35 U.S.C. 154(b) by 0 days.

(21) Appl. No.: 13/999,674

(22) Filed: Mar. 17, 2014

(65) Prior Publication Data

US 2015/0011124 A1 Jan. 8, 2015

Related U.S. Application Data

(60) Provisional application No. 61/852,080, filed on Mar. 15, 2013.

(51) Int. Cl.

| | |
|---|---|
| ***H01R 13/66*** | (2006.01) |
| ***H01R 13/703*** | (2006.01) |
| ***H01R 31/08*** | (2006.01) |
| *F21S 4/00* | (2006.01) |
| *F21W 121/00* | (2006.01) |

(52) U.S. Cl.

CPC ..... *H01R 13/6616* (2013.01); *H01R 13/7032* (2013.01); *H01R 31/08* (2013.01); *F21S 4/001* (2013.01); *F21W 2121/00* (2013.01)

(58) Field of Classification Search

CPC ..... H01R 13/6616; H01R 31/08; H01R 13/7032; F21S 4/001; F21W 2121/00

USPC ..... 439/620.02, 188

See application file for complete search history.

(56) References Cited

U.S. PATENT DOCUMENTS

| | | | | |
|---|---|---|---|---|
| 3,808,581 | A * | 4/1974 | Murray | 439/490 |
| 6,257,740 | B1 * | 7/2001 | Gibboney, Jr. | 362/288 |
| 6,533,437 | B1 * | 3/2003 | Ahroni | 362/249.14 |
| 7,261,458 | B2 * | 8/2007 | Janning | 362/652 |
| 7,626,131 | B1 * | 12/2009 | Gibboney, Jr. | 200/51.1 |
| 2010/0099285 | A1 * | 4/2010 | Li et al. | 439/188 |
| 2011/0136361 | A1 * | 6/2011 | Cheng et al. | 439/188 |

* cited by examiner

*Primary Examiner* — Edwin A. Leon

(74) *Attorney, Agent, or Firm* — Brian K. Johnson, Esq., LLC

(57) ABSTRACT

A shunting mechanism is provided within a socket of a light string system having a resistive element that substantially mirrors the resistive characteristic of the bulb inserted in the socket. The shunting mechanism is disabled when the bulb is inserted into the light string socket. When the bulb is removed from the light string socket, the shunting mechanism bridges the internal socket leads so as to maintain current flow and power delivery at levels similar to those provided when the bulb is present. In one embodiment, the resistive element is a resistive coating on the shunting mechanism or a resistive node on the shunting mechanism. In other embodiments, the resistive element is applied to the socket's internal leads. In yet other embodiments, the resistive element consists of sophisticated electronic circuitry specifically designed to mirror the resistive characteristics of the bulb assembly.

13 Claims, 11 Drawing Sheets

APPARATUS AND METHOD FOR PROVIDING A RESISTIVE SHUNT WITHIN A LIGHT STRING

CROSS REFERENCE TO RELATED APPLICATIONS

This application claims priority to and the benefit of U.S. Provisional Patent Application No. 61/852,080 filed Mar. 15, 2013 and titled "APPARATUS AND METHOD FOR PROVIDING A RESISTIVE SHUNT WITHIN A LIGHT STRING" the contents of which are incorporated by reference herein in their entirety.

STATEMENT REGARDING FEDERALLY SPONSORED RESEARCH OR DEVELOPMENT

Not applicable.

BACKGROUND OF THE INVENTION

1. Field of the Invention

The invention is for a system and method for providing a resistive shunt that provides for connecting two terminals within a light socket of a light string when the bulb is removed. Essentially, a resistive element is included as part of or comprises the socket bridge itself such that when the light bulb is removed, the electrically resistive element is provided in series with the bridge so as to present the same resistance between the external socket leads as that provided by the bulb when it is inserted into the socket and operational. In this manner, the overall resistance characteristics of the light string are not changed upon the removal of one or more bulbs in the light string and power/current demand increases are avoided within the light string system upon bulb removal.

2. Description of the Prior Art

Holiday light strings are an omnipresent facet of many holiday decoration displays. Safety is one of the primary concerns in designing these light string systems. In particular, the removal of bulbs from the sockets within which the bulb typically resides presents several practical operational problems as well as safety concerns. Numerous bridging technologies exist that provide for a closed circuit condition within the socket when bulbs are removed such that the remaining bulbs in the light string remain lit. For Example, U.S. Pat. No. 7,591,658 issued on Sep. 22, 2009 to Chen (hereinafter "Chen") provides one such shunting system in which one of the legs of an electrically conductive torsion spring is moved into a bridging position connecting the internal socket leads when the bulb is removed from the socket. One problem with this arrangement, however, is that the torsion spring is typically made of copper or another low resistance conductor. Thus, the removal of the bulb, including its associated filament resistance, causes the current drawn by the light string to increase upon bulb removal. If numerous bulbs are removed from a string, this problem increases, potentially to the point of dangerous operation. Commercial light string systems are typically rated for a maximum current draw or power consumption, and any increases up to or over those limits may be considered a safety hazard.

Underwriters Laboratories (UL) is a safety consulting and certification company that provides safety-related certification, validation, testing and inspection services. The organization advises and trains manufacturers of commercial manufacturers on various safety-related topics. UL certification is often a requirement for commercially distributed electrical systems to be offered to the public. Many retail outlets that offer holiday light string systems, for example, require that the light strings and components offered by their manufacturers pass UL certification as a condition of being offered for sale in their retail establishments. Numerous other worldwide certification organizations exist that provide similar functions and services.

Maximum light string current draw or power consumption is one of the most recent safety requirements to be formulated by electrical safety, standards-setting bodies. UL 588, for example, covers seasonal and holiday decorative products, specifically "factory-assembled seasonal lighting strings with push-in, midget-screw, or miniature-screw lamp holders connected in series for across-the-line use or with candelabra- or intermediate-screw lamp holders connected in parallel for direct-connection use . . . . [and] which are portable and not permanently connected to a power source." To achieve UL certification under this specification section, a shorting test of light sockets shunts is conducted wherein bulbs are removed one at a time until many bulbs are removed from a single string. To achieve UL certification under this standard, the current of the light string shall not increase beyond a certain percentage, typically 10%.

Thus the need exists in the industry in which a shunting mechanism is provided, within a bulb socket and external to the bulb itself, such that the resistive characteristics of the shunt mirror those of the removed bulb. This may be as simple as matching a resistance of the two. In more complicated systems, the bulb circuitry can be mirrored within the shunting mechanism itself. In any case, any number of bulbs may be removed from the light string containing such a system without appreciable increased in current or power dissipation, thereby achieving the goals of the above-mentioned standards organizations and creating a safer light string system.

BRIEF SUMMARY OF THE INVENTION

In one particularly preferred embodiment, a light string socket is provided having at least two leads through which electrical power is delivered to the socket, the socket configured to receive a bulb assembly having two bulb leads, the two bulb leads being in electrical contact with the at least two socket leads such that when the bulb assembly is seated in the socket the electrical power flows through the bulb, the socket including: a shunt within the socket, the shunt bridging the at least two electrical leads within the socket when the bulb is not seated in the socket, and a resistive element is coupled to either the shunt or the leads such that the electrical power flows through the resistive element and the shunt when the bulb is not seated in the socket, the resistive element being matched to a resistive characteristic of the bulb so that the electrical power provided to the socket is substantially similar whether the electrical power is consumed by the bulb or the resistive element.

In other aspects of this embodiment, the resistive element is one of: a carbon coating deposited on the shunt, a resistor, a microelectronic circuit module, a resistive bead, or a spring; or the shunt is mechanically coupled to one of the at least two leads; or the resistive characteristic is an electrical resistance of the bulb and a resistance of the resistive element is matched to the electrical resistance of the bulb.

In another particularly preferred embodiment of the invention, a light string socket is provided having at least two leads through which electrical power is delivered to the socket, the socket configured to receive a bulb assembly having two bulb leads, the two bulb leads being in electrical contact with the at least two socket leads such that when the bulb assembly is seated in the socket the electrical power flows through the bulb, the socket including: a shunt within the socket, the shunt bridging the at least two electrical leads within the socket when the bulb is not seated in the socket, the shunt being composed of a resistive material such that it provides a resistive element, the electrical power flowing through the resistive element when the bulb is not seated in the socket, the resistive element being matched to a resistive characteristic of the bulb so that the electrical power provided to the socket is substantially similar whether the electrical power is consumed by the bulb or the resistive element.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
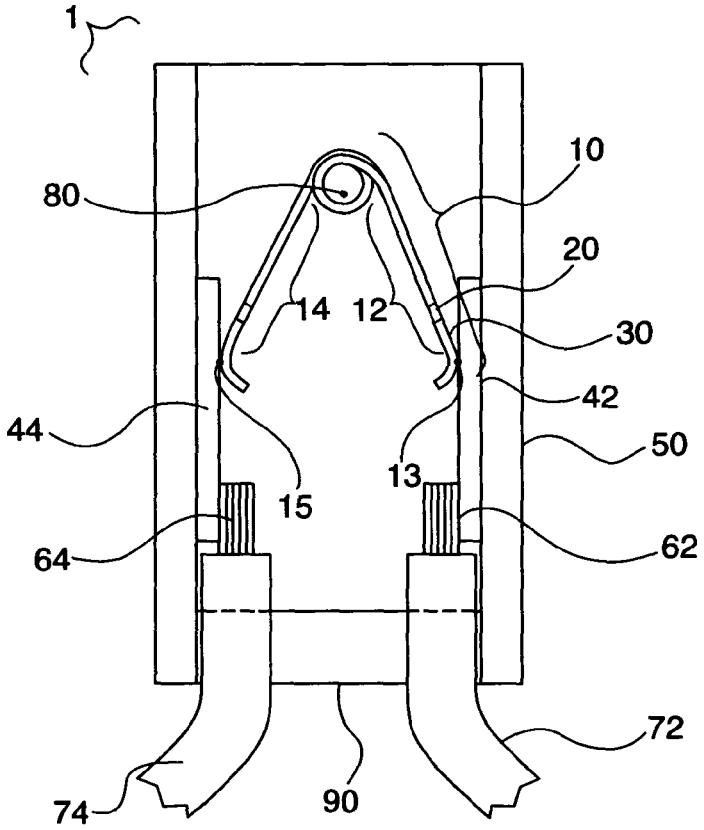
FIGS. 1 and 2 show a first light string socket bridging arrangement containing a fixed resistive element according to one embodiment of the present invention.

To facilitate a clear understanding of the present invention, illustrative examples are provided herein which describe certain aspects of the invention. However, it is to be appreciated that these illustrations are not meant to limit the scope of the invention, and are provided herein to illustrate certain concepts associated with the invention.

The present invention provides for the inclusion of a resistive element within the bridging mechanism that resides within a light string socket. The bridging mechanism and resistive element are an integral part of the socket and are external to the bulb. The purpose of the resistive element is to replicate, as closely as possible, the resistive characteristics of the bulb itself so that when the bulb is removed from the socket, the bridging mechanism accommodates the same load current being supplied to the socket. This enables the remainder of the light string to function under electrical conditions substantially equivalent to those experienced when the bulb is present in the socket.

It should be noted that the term bulb is used in this description to denote an electrically powered element that produces light. Although most of the disclosure is directed to incandescent bulbs found on light strings, those of skill in the art will recognize the teachings of the present invention to be applicable to any of a variety of electrically powered lights such as LEDs, phosphorescent bulbs, luminescent bulbs, and other electric bulbs. Further, is should be noted that a resistive element as used herein includes any electrically conductive resistor, or resistive element including but not limited to: a carbon resistor, surface mount resistor, a semiconductor material, carbon nanotube structures, a matrix resistive structure, or a resistive substance, coating or contact, etc.

The overall problem with not providing a resistive element of the type disclosed herein is that the overall light string, or series connected segment thereof, experiences an increase in current flow within the light string when a bulb is missing. In a series-connected electrical circuit, the missing bulb causes each of the remaining series connected bulbs to have the same supply voltage applied across their, now lower, total resistance. This is a result of Ohm's law, which for a series of serially connected resistors, R1 through Rn, states: $I=V/(R1+R2-R3+R4+\ldots+Rn)$, where V is the supply voltage applied across the series-connected light string and I is the resultant current flowing through the light string. So it is clear from Ohm's Law that as the total resistance of the series-connected light string ($R1+R2-R3+R4+\ldots+Rn$) decreases with the removal of each bulb, the current drawn by the overall circuit necessarily increases under a constant supply voltage. Commensurately, the voltage across each remaining resistor (bulb) also increases. Since the power (P) consumed by the bulb is given by the equation $P=IV$, and the current in the entire circuit increases with each missing bulb, the total power applied to the string as well as the power consumed by each bulb increases as bulbs are removed. Theoretically, this increases with each bulb removed until unsafe conditions are reached within the light string and a built-in fuse arrangement kicks in to stop current delivery or the overall light string system simply burns out and fails.

Many decorative light strings available on the market contain a shunting mechanism that is made of a highly conductive material (e.g. copper) having a low resistance in comparison to the resistive inductance of the light bulb that has been removed from the socket. Resistivity quantifies how strongly a given material opposes the flow of electric current and is a function of the geometry of the resistor. As one reference point, a 10 gauge AWG copper wire has approximately a 102 mil diameter and a resistance of approximately 1.018 Ohms per 1000 feet at temperature of 55 degrees Fahrenheit. In contrast, a typical light string bulb has a resistance of 7 to 8 Ohms through the filament. Shunts are also included within many light bulbs to permit current carrying through the bulb if the filament burns out. The inner-bulb shunt wire contains a coating that provides a fairly high resistance until the filament fails. At that point, heat caused by current flowing through the shunt burns off the coating and reduces the inner-bulb shunt's resistance. However, even after burn off, the bulb shunt still provides 2 to 3 ohms of resistance through the shunt once the coating burns off. Both of these values are significantly in excess of the resistance offered by the highly conductive materials currently used as shunts. Thus the need exists to provide a shunting mechanism within the light socket that more closely matches the resistance provided by the bulb filament such that the removal of one or more bulbs permits the continued illumination of the reaming light string bulbs without a significant increase in the light string current and power consumption.

The attached Figures illustrate various embodiments of light string sockets in which the removal of one or more bulbs on the light string still permit the remaining bulbs on the string to stay illuminated without the risk of increased current being applied to the remaining bulbs in the string. Such conditions are not only unsafe and fail to meet the newer electrical certification specifications, but they shorten the remaining bulbs' life span and cause uneven illumination of adjacent, series-connected light string segments.

Referring to FIG. 1, a typical cross-sectional view of a light string socket 1 is provided in which the bulb assembly has been removed. Socket 1 includes a shunting mechanism 10 that bridges two inner-socket terminals 42 and 44 so as to provide electrical connectivity between them through the shunting mechanism 10. Socket 1 further includes insulated lead wires 72 and 74 having wire leads 62 and 64 respectively that provide power to the light bulb socket via electrical coupling of the wires leads to the two inner-socket terminals 42 and 44 respectively. Wire securing wedge 90 is provided to secure mechanical placement of the lead wires 72 and 74 within the outer housing 50 of socket 1. Attachment post 80 provides for uniform placement of the shunting mechanism 10 within the socket 1 such that proper registration of the shunt legs 12 and 14 is made with terminals 42 and 44 respectively and proper electrical connection between them is made at contact points 13 and 15 respectively. Once fully assembled and powered, current flows (depending on direction) from lead wires 72 and 74 through wire leads 62 and 64 across terminals 42 and 44, and through shunt 10 so as to electrically connect the two socket lead wires and wire leads.

Shunting mechanism 10 is typically made of a highly conductive material such as copper. According to one preferred embodiment of the invention, a resistive sheath 20 may be applied at one or both ends of the shunt legs 12 and 14. This sheath may, optionally, be further coated by an outer conductive sheath 30 applied atop one or both resistive sheathes 20 at the contact points 13 and 15 where the socket makes electrical connection with the shunt legs. Any one of a number of resistive coatings may be used such as a compressed carbon compound. Depending on the carbon composition and the geometric considerations of the resistive sheath, such as sheath thickness, resistive values of approximately 15-20 Ohms are achievable that are capable of safely handing ¼ watt of power. In yet another embodiment, the outer conductive sheath 30 is composed of copper flash plating that is applied to the ends of the shunt legs at connection points 13 and 15 to improve the connection with the copper or bronze terminals 42 and 44.

Figure 2:
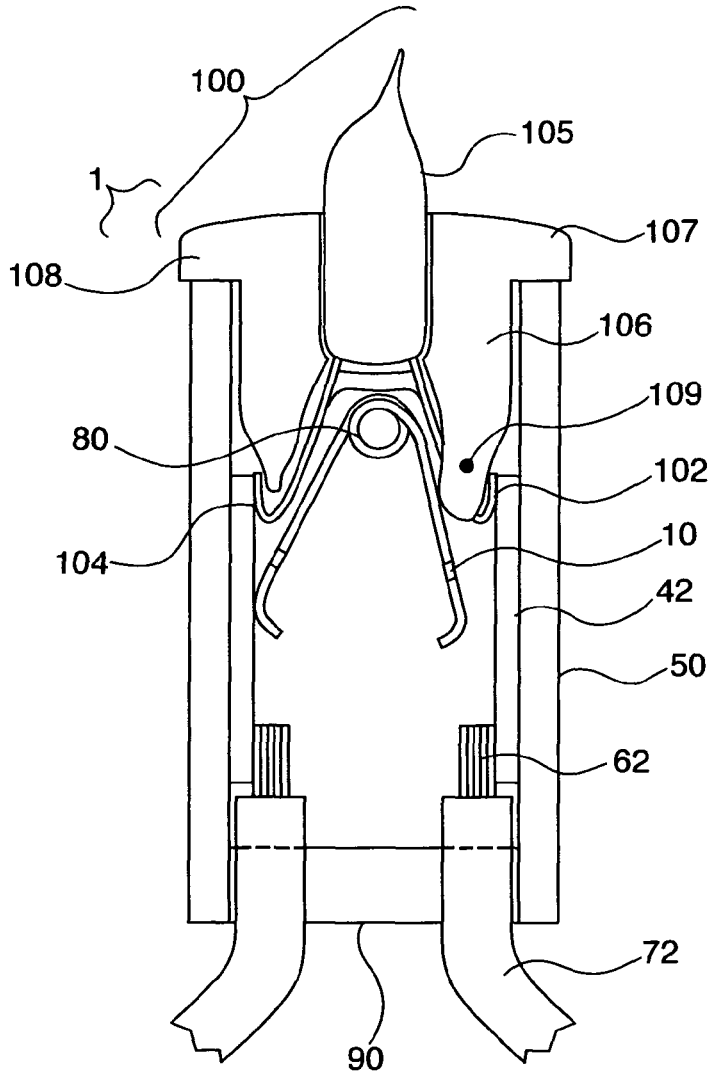

Referring to FIG. 2, the light socket of FIG. 1 is provided containing a light bulb assembly 100 having a lighting element or light bulb 105 a lighting element holder or light bulb holder 106 and light element or bulb leads 102 and 104. Bulb leads 102 and 104 are electrically connected to the filament and/or inner-bulb shunt within bulb 105, neither of which is shown in FIG. 2. Bulb leads are also arranged such that when bulb 100 is seated within socket 1, e.g. bulb holder flanges 107 and 108 are flat against socket housing 50 and the bulb leads 102 and 104 are in electrical contact with leads 42 and 44 respectively. Also as shown in FIG. 2, mechanical biasing element 109 makes contact with leg 12 of shut mechanism 10 so as to push that leg inward toward the interior of the socket and out of electrical connection with terminal 42 thereby moving the shunt mechanism 10 and breaking the shunt's electrical connection within the socket. Once fully seated, current flows from lead wires 72 and 74 through wire leads 62 and 64 across terminals 42 and 44, thorough bulb leads 102 and 104 and across the light bulb filament so as to illuminate the bulb.

Figure 3A:
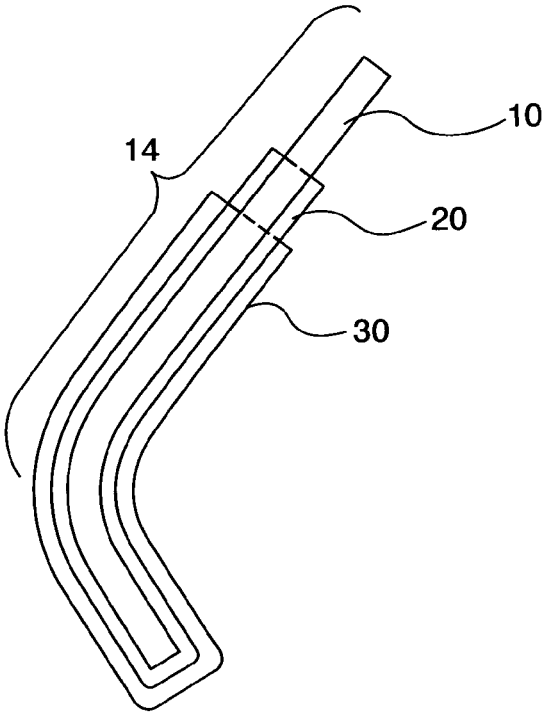
FIGS. 3A-3B show two different resistive elements on the light socket bridging elements according to various embodiments of the present invention.
Figure 3B:
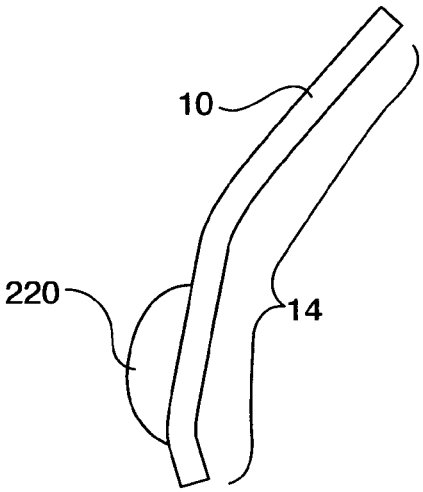

Referring to FIG. 3, various arrangements of the shunt mechanism legs are provided. In FIG. 3A, a shunting mechanism 10 having a leg 14 is shown. If the composition of the leg (and/or the entire shunting mechanism) is of a material possessing a high resistivity, i.e. higher than copper, then the singularly manufactured shunting mechanism itself my become the resistive element and can be used to replace existing light socket shunting mechanisms without further assembly or processing steps. Alternatively, shunt mechanism leg 14 may be coated with a resistive element 20 which may be comprised of a coating applied to the shunt leg by any of a number of plating, deposition or other adhesion processes. In turn, a conductive coating 30 (e.g. copper) may be further applied or deposited on top of the resistive element so as to provide better electrical contact with the socket terminal when the shunting mechanism is engaged. As shown in FIG. 3B, an alternate location for the resistive element 220 is also show as a bead or dot 220 that is bonded to shunt leg 14 at the location of electrical contact with the socket terminals.

The key to the present invention is to substantially match the overall resistive characteristics of the shunt mechanism 10 with that of the bulb assembly such that the electrical current and power flow over the remaining portions of the light string remain substantially constant. Ideally, the resistive characteristics of the shunt mechanism at the two points of contact with the socket terminals is matched to the resistive characteristic of the bulb assembly at the same points. In one embodiment, the electrical resistance of the bulb assembly may simply be matched to that of the shunt mechanism. At the highest level of sophistication, the light bulb assembly may be a complicated structure containing microelectronic circuitry and numerous illumination elements. In this arrangement, the resistively profile of the light bulb assembly may be represented by a complex and dynamic resistivity function. It is this function that would be matched within the resistive element of the shunt mechanism so as to maintain consistent functioning of the light string. In practice, an exact matching between the resistively characteristics of the light bulb assembly and the shunting mechanism will neither be possible nor desirable. Rather, in practice, a substantial matching function will likely be implemented according to a metric by which the light string performance is measured. In this manner, and through the plurality of shunting mechanisms used within a light string, an acceptable variation about a mean current or power fluctuation may be accomplished during typical light string operation.

Figure 4:
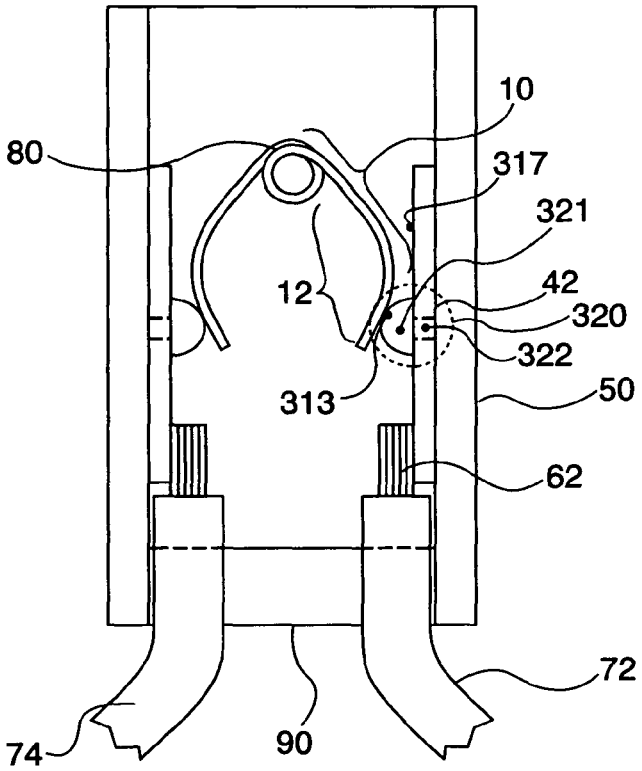
FIGS. 4-7 show alternative light string socket bridging arrangements containing a fixed resistive element according to various other embodiments of the present invention.

FIG. 4 provides yet another embodiment of the present invention. Here, similar to FIG. 3B, resistive element 320 is provided as a bead or dot 321 that is bonded, in this embodiment, to the socket terminal 42 at the location of electrical contact 313 with the shunt mechanism leg 12. The resistive element may be a resistive material such as a compressed carbon compound. The resistive element 320 is added to the terminals only in the area 313 where the shunting mechanism makes contact with the socket terminal but not in the area 317 in which the bulb terminals make contact with the socket terminals. The resistive element may be bonded to a conductive plate that is mechanically affixed to the terminal by a rivet like structure 322 or otherwise soldered to the terminal.

Figure 5:
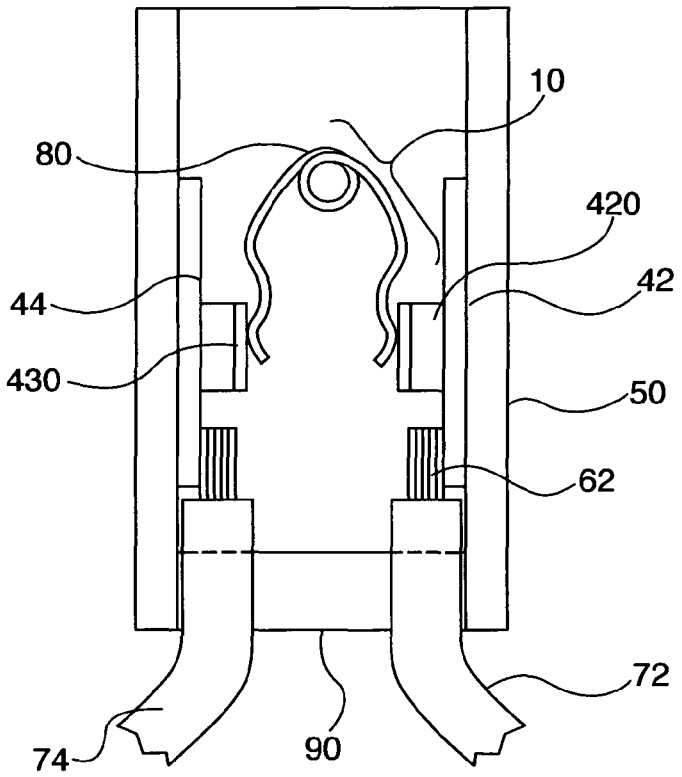

FIG. 5 shows a variation of the embodiment of FIG. 4 in which the resistive element 420 is again affixed to terminals 42 and 44. In this arrangement a higher resistivity material (e.g. carbon compound) is bonded to or otherwise deposited on to the terminals as part of the manufacturing process. A rivet-like structure or solder may be used to bond the resistive element to the terminal. Conductive contact plate 430 made of the same material as the conductive shunt mechanism may be further affixed to the resistive element. Again, the resistive element(s) 420 are so constructed such that the end-to-end contact resistance, as seen at the socket terminals, through the resistive elements and the shunt mechanism are substantially similar to the resistive characteristics provided by the light bulb assembly, which when inserted into the socket, disengages the shunt mechanism and any associated resistive elements. In alternative arrangements of FIGS. 4 and 5 (not shown) only one terminal includes a resistive element which is properly configured and constructed according to the teachings of the present invention.

Figure 6:
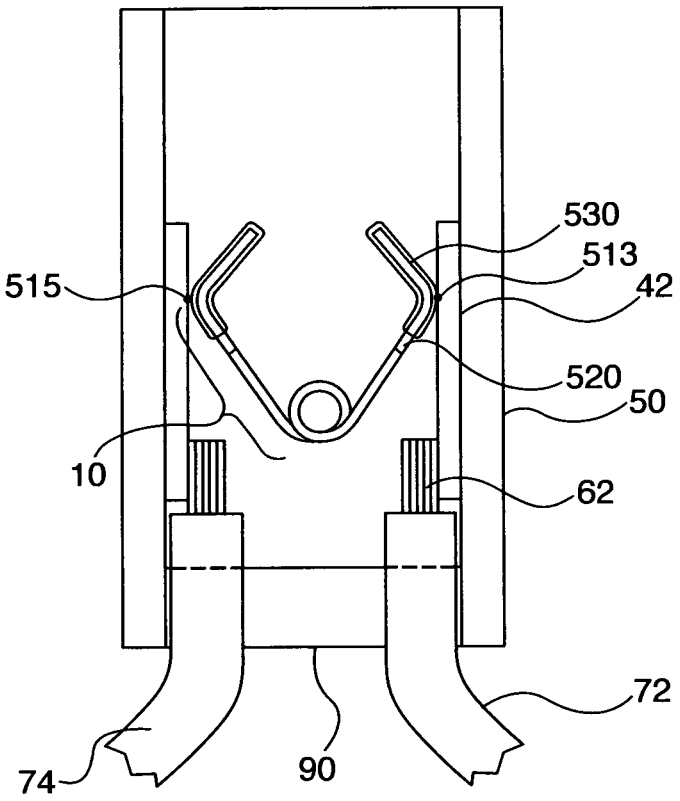
Figure 7:
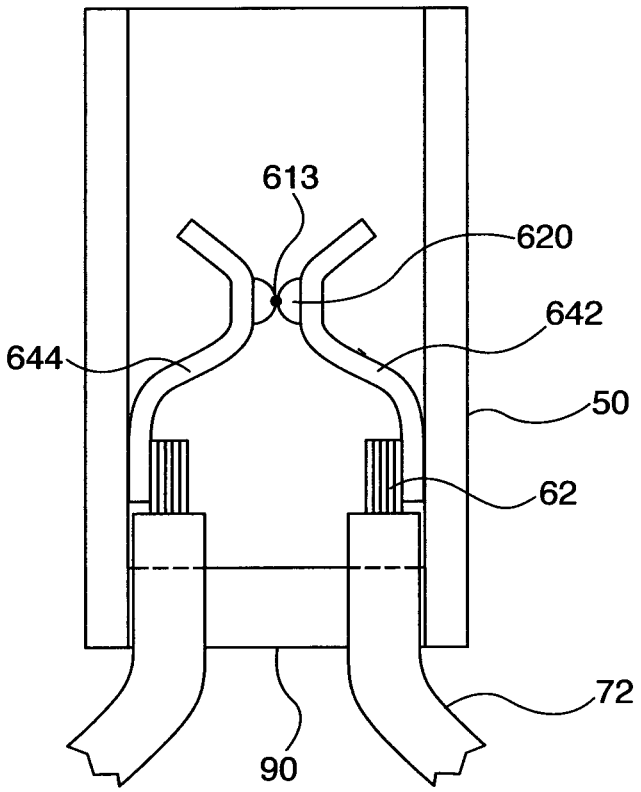

In FIG. 6, the shunt mechanism 10 is coated at the ends of the legs of the shunt mechanism, as described above. However, in this arrangement, the legs of the shunt mechanism are inverted (pointed up) and its leg ends bend inward towards the socket interior at the contact points 513 and 515. In this manner, shunt mechanism legs provide contact with the socket terminals through the resistive coating 520 when the shunt is active and are pushed away from the terminals when the bulb seated in the socket In FIG. 7, the inward bending terminals 642 and 644 are the shunting mechanism themselves and their spring activity causes them to come in contact it the middle of the socket at a single contact point 613 when the bulb is not seated in the socket. Higher resistance material (e.g. carbon compounds) provides the resistive element 620 as affixed to the terminals. As with the arrangements above, a separate conductive plate (not shown) may be bonded to the resistive element(s) which, in turn, are mechanically affixed to the terminal by a rivet-like structure or soldered to the terminal.

Figure 8:
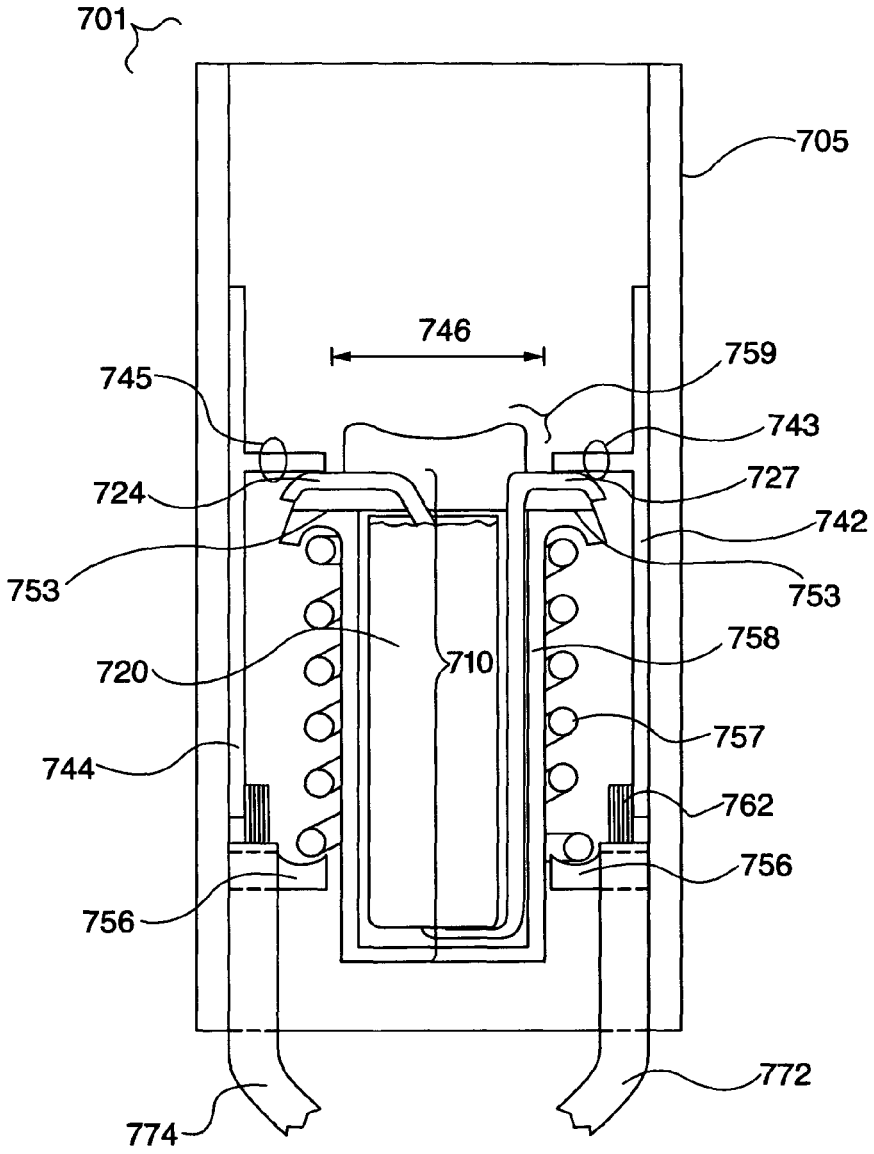
FIGS. 8-11 show alternative light string socket bridging mechanisms including a spring arrangement coupled with or as part of fixed resistive element according to various other embodiments of the present invention.

FIG. 8 provides for yet another light string socket to which the teachings of the present invention may be applied. In that embodiment, the socket terminals 742 and 744 have flange portions 743 and 745 extending into the socket cavity but allowing for a gap 746 to be formed therebetween. A plunger cartridge 759 having a bottom cartridge portion 758 is disposed within socket 701 between the flange portions 743 and 745 and a securing plate 756 disposed at the bottom of the socket. The plunger cartridge further contains outwardly extending flange portions 753 which, in one variation, may be a continuous circular shelf disposed around the top of plunger cartridge 759. The flange portions extend outward from said plunger cartridge 759 so as to cause the upper surface area of the plunger cartridge to be larger than gap 746 left by the flange portions 724 and 727 of the terminals.

Spring element 757 is disposed around the outside of plunger cartridge 759 and is seated between outwardly extending flange portions 753 the on the top of the cartridge and the securing plate 756 disposed at the bottom of the socket. The spring provides upward force on the plunger cartridge 759 so as to place the plunger cartridge 759 in a fully upward extended position, causing the extending flange portions 753 of plunger cartridge 759 to contact flange portions 724 and 727 of the socket terminals when no light bulb assembly is seated in the socket. When a light bulb assembly is seated in the socket, plunger cartridge 759 is pushed downward thereby compressing spring element 757 and releasing the extending flange portions 753 of plunger cartridge 759 from contact with the flange portions 724 and 727 of the socket terminals. It should be appreciated that spring could also be disposed within the plunger cartridge 759 with appropriate provision of cartridge flanges so as to perform the same above-recited function.

In the embodiment of FIG. 8, the resistive element 710, including resistive portion 720, is placed within the plunger cartridge 759 and includes top lead 724 and bottom lead 727. Top lead 724 extends from the top of plunger cartridge 759 above flange portion 753 so at to make electrical contact with flange portion 724 of socket terminal 744. Likewise, bottom lead 727 extends from the bottom of plunger cartridge 759 up through the cartridge and extends outside the cartridge above flange portion 753 so at to make electrical contact with flange portion 743 of socket terminal 742. The plunger cartridge top and bottom portions may be ultrasonically welded, glued or otherwise bonded together after the resistive element is inserted in the cartridge. Likewise, the securing plates 756 may similarly be bonded or ultrasonic welded to the side walls of the socket securing the spring and lead wires 772 and 774.

In operation, when a light bulb assembly is inserted into socket 701, plunger cartridge 759 is pushed downward compressing spring element 757 and releasing electrical connection of top lead 724 and bottom lead 727 of resistive element 710 from electrically bridging a connection between flange portions 724 and 727 of the socket terminals. In this position, upper side portions of the terminals 742 and 744 are in electrical connection with the bulb leads on the bulb assembly thereby providing electrical current and power to the bulb to illuminate it. (See FIG. 10.) When the bulb assembly is removed from the socket, plunger cartridge 759 is pushed upwards by spring element 757 causing electrical connection of top lead 724 and bottom lead 727 of resistive element 720 to form a bridging connection between flange portions 724 and 727 of the socket terminals. In this position, the current is passed through the resistive element and through the socket to other sequentially coupled sockets in the light string system.

After experimental evaluation, a resistive element 710 may comprise a simple, inexpensive carbon resistor having a value of 20 to 22 ohms and a power rating of ¼ watt.

Figure 9:
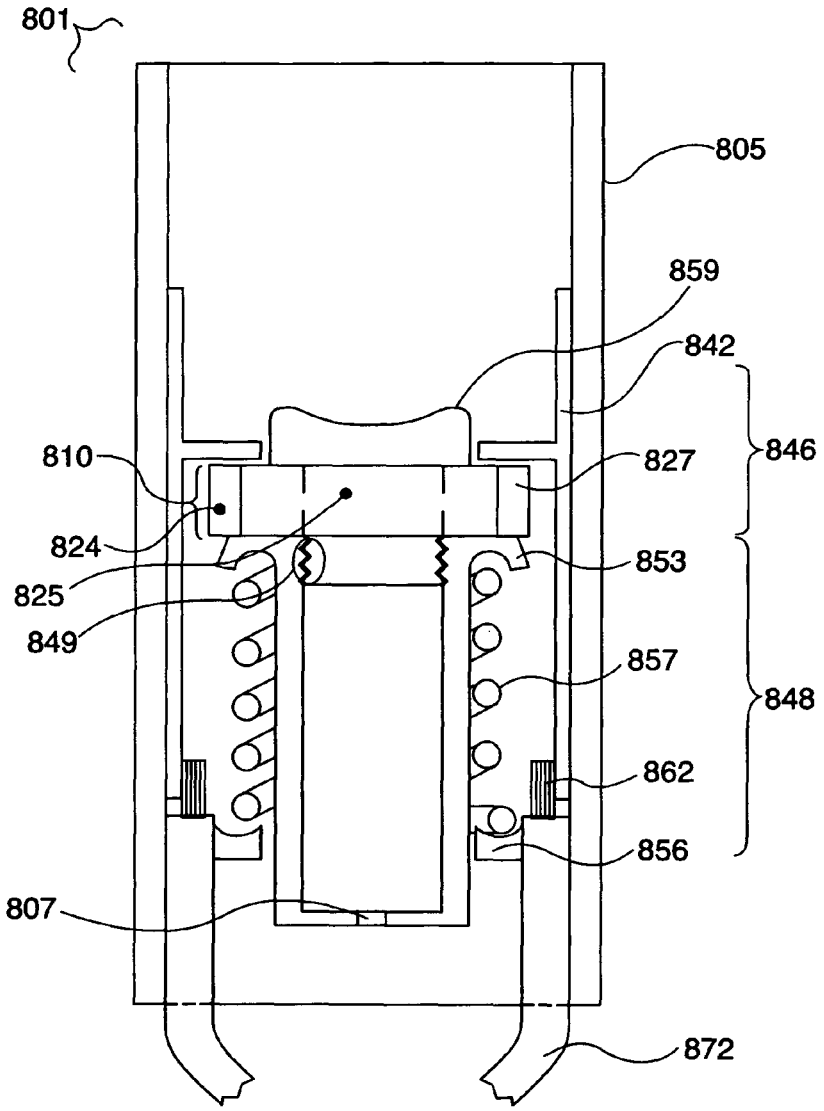

FIG. 9 provides an alternative arrangement of the placement of the resistive element 810. In this embodiment the plunger cartridge 859 is composed of a top portion 846 and a bottom portion 848. Top portion 846 and a bottom portion 848 are threadably engaged to one another via threaded connections 849 disposed within both sections. Engagable slot 807 is provided at the bottom of the plunger cartridge 859 so that a screw driver or other tool may be conveniently used to securely enable the threadable engagement. Top portion 846 further includes the resistive element 810 which contains central portion 825 and resistive element leads 824 and 827 connected thereto. A resistor, resistive structure, resistive substance, resistive coating, surface mount resistor etc. (820 not shown) may be disposed anywhere within central portion 825 and electrically connected with leads 824 and 827 such that electrical connection is made between the flange portions of the socket terminals through resistive element 820 when the plunger cartridge 859 is fully pushed up (i.e. when the bulb assembly is removed). Otherwise the operation of the embodiment of FIG. 9 is substantially similar to that provided with respect to FIG. 8.

Figure 10:
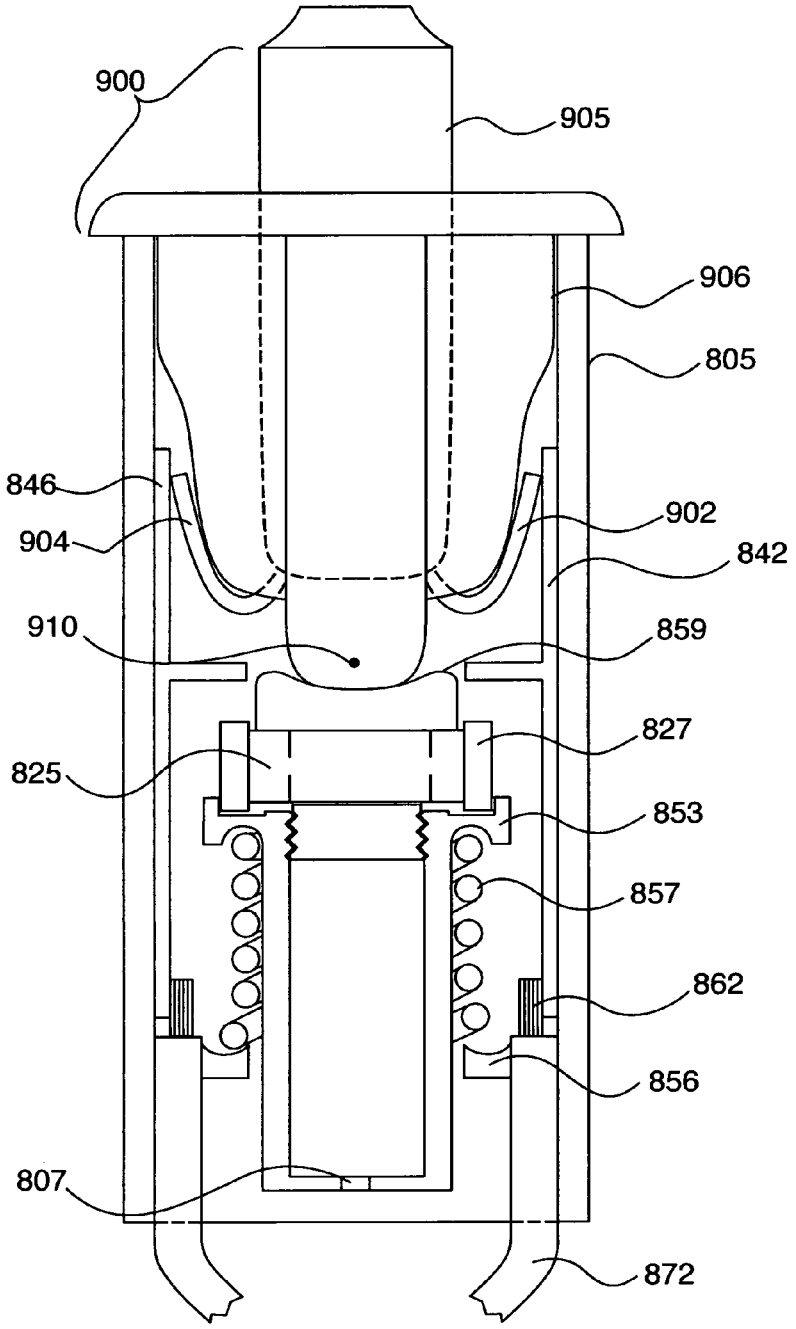

FIG. 10 provides the light 801 socket of FIG. 9 with the light bulb assembly 900 inserted into the socket 801. Light bulb assembly includes lighting element holder or light bulb holder 906 and light element or bulb leads 902 and 904. Bulb leads 902 and 904 are electrically connected to the filament and/or inner-bulb shunt within bulb 905, neither of which are shown in FIG. 10 and are also connected to socket terminals 842 and 846 so as to provide power to the light bulb assembly. In the seated position, the bottom end of light bulb assembly 910 pushes the top portion of the plunger cartridge 859 down causing spring element 857 to compress thereby releasing resistive element 820 from electrical connection to the terminal flanges.

Figure 11:
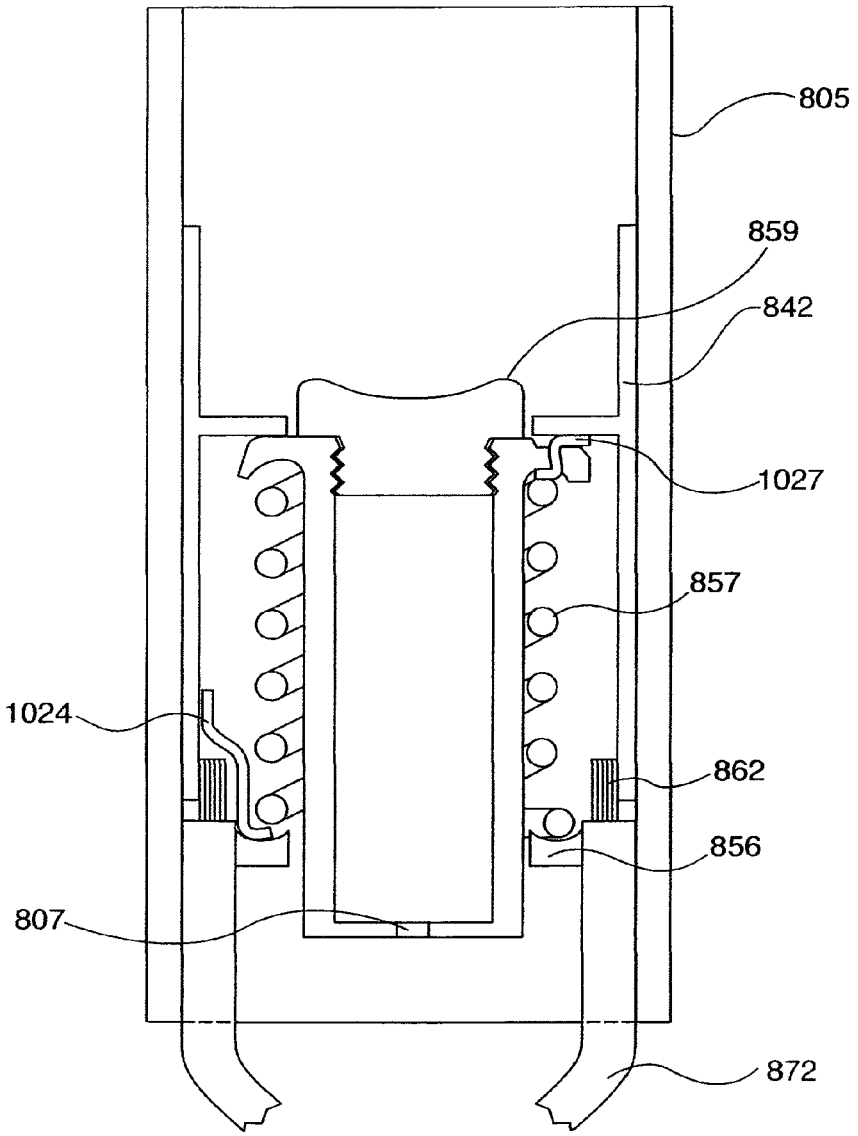

FIG. 11 discloses an embodiment in which the spring element 857 itself is the resistive element 810. The spring element 857 can be made of any of a number of semi-resistive or semiconductor materials, or a high resistance metallic alloy including, but not limited to, a nickel chrome alloy, or spring element may be coated with resistive coatings either over the entire spring or at its connective ends. Leads 1024 and 1027 are coupled to spring element, one at each end, and the socket terminals and provide electrical connection across those terminals through spring element 857. Alternatively, one or more of the leads 1024 and 1027 themselves may be the resistive element 810 with the spring being left as a natural copper conductor.

With respect to creating resistive structures about conductors, one method of applying a carbon compound resistive coating to a wire is to place the formed wire in a mold, close the mold and inject a slurry of the compound into the mold to fill the cavity desired around the wire. While in the mold, the mold and wire are heated for a specific time period at a specific temperature. Depending on the chemicals and chemical processes being used, the resultant compound can be made to bond to the wire. After boding, a plating process may be used to provide the outer conductor wherein the wire ends are placed in a copper plating bath with an electrical bias applied to the bare wire end causing the copper plating to adhere to the carbon compound.

With respect to the deposition of resistive materials onto a conductive element to create the resistive element of the present invention, any of the heretofore known or later developed methods of material deposition/adherence may be used. For example, one method of applying a carbon compound resistive coating to a wire is to place the wire in a vacuum chamber, with the area not to be coated masked off, and exposing the remaining wire to a heated vapor cloud of the carbon compound with a positive bias on the masked end of the wire. When the vapor cloud having positively charged partials is subject to the electrical field, its particles are caused to adhere to the unmasked portions of the wire. The process is extended until a desired thickness of carbon is deposited on the wire. After removal from the chamber, additional chemical vapor deposition (CVD) processes may be exercised to plated additional conductive and resistive materials on the wire.

In addition to CVD techniques, sputtering, sintering, electron beam, x-ray lithography and various other chemical deposition techniques may be employed to create resistive structures as contemplated according to the teachings of this invention While the invention has been shown and described with reference to specific preferred embodiments, it should be understood by those skilled in the art that various changes in form and detail may be made therein without departing from the spirit and scope of the invention as defined by the following claims.

What is claimed is:

1. A light string socket having at least two leads through which electrical power is delivered to said socket, said socket configured to receive a bulb assembly having two bulb leads, said two bulb leads being in electrical contact with said at least two socket leads when said bulb assembly is seated in said socket, said electrical power flowing through said bulb across said two bulb leads when said bulb assembly is seated in said socket, said socket comprising:

an electrically conductive shunt within said socket, said shunt bridging said at least two leads within said socket when said bulb assembly is not seated in said socket, said bulb assembly disengaging said bridging when said bulb assembly is seated in said socket and a resistive element coupled in electrical series between said electrically conductive shunt and said socket leads such that said electrical power flows through said series-connected resistive element and said shunt when said bulb is not seated in said socket, said resistive element being matched to a resistive characteristic of said bulb assembly, said electrical power provided to said socket being substantially similar when either said electrical power is provided to said bulb when said bulb assembly is seated in said socket or said electrical power is provided to said resistive element when said bulb is not seated in said socket.

2. The light string socket of claim 1 wherein said resistive element is one of: a resistive coating deposited on said shunt, a resistor, a microelectronic circuit module, a resistive bead, or a spring.

3. The light string socket of claim 1 wherein said shunt is mechanically coupled to one of said at least two socket leads.

4. The light string socket of claim 1 wherein said resistive characteristic is an electrical resistance of said bulb assembly and said resistive element is matched to said electrical resistance of said bulb assembly.

5. An electrically conductive shunt disposed within a light socket, said light socket having at least two leads through which electrical power is delivered to said socket, said socket configured to receive a bulb assembly having two bulb leads, said two bulb leads being in electrical contact with said at least two socket leads when said bulb assembly is seated in said socket, said electrical power flowing through said bulb across said two bulb leads when said bulb assembly is seated in said socket, said electrically conductive shunt bridging said at least two leads within said socket when said bulb assembly is not seated in said socket, said bulb assembly disengaging said bridging when said bulb assembly is seated in said socket, said electrically conductive shunt including a resistive element, said resistive element making an electrical series coupling between said electrically conductive shunt and at least one of said socket leads when said electrically conductive shunt is inserted in said light socket, said electrical power flowing through said series-connected resistive element and said shunt when said bulb is not seated in said socket, said resistive element being matched to a resistive characteristic of said bulb, said electrical power provided to said socket being substantially similar when either said electrical power is provided to said bulb when said bulb assembly is seated in said socket or said electrical power is provided to said resistive element when said bulb is not seated in said socket.

6. The electrically conductive shunt of claim 5 wherein said resistive element is one of: a resistive coating deposited on said shunt, a resistor, a microelectronic circuit module, a resistive bead, or a spring.

7. The electrically conductive shunt of claim 5 wherein said resistive characteristic is an electrical resistance of said bulb and a resistance of said resistive element is matched to said electrical resistance of said bulb assembly.

8. The light string socket of claim 3 wherein said shunt is a pair of shunts, one each mechanically coupled to both of said at least two leads and said resistive element is a resistive bead disposed between said two shunts.

9. The light string socket of claim 1 wherein said shunt is a pair of shunts, one each mechanically coupled to both of said at least two leads and said resistive element is a resistive bead disposed between said two shunts.

10. The light string socket of claim 1 wherein said resistive element is disposed within a cartridge, said resistive element having a pair of resistive leads extending from one end of said cartridge, said resistive leads electrically coupled to said shunt within said light socket when said bulb is not seated in said socket, said socket including a spring disposed around said cartridge and biasing said cartridge to said electrically coupled position when said bulb is not seated in said socket, said spring being depressed and said cartridge being pushed into said socket when said bulb is seated in said socket, said resistive leads electrically decoupled from said shunt within said light socket when said bulb is not seated in said socket.

11. A method of operating a light string having a plurality of light sockets, each light socket having at least two leads through which electrical power is delivered to said socket, each socket configured to receive a bulb assembly having two bulb leads, said two bulb leads being in electrical contact with said at least two socket leads when said bulb assembly is seated in said socket, said two bulb leads coupled to a light source within said bulb assembly, said light source providing an illumination to said bulb assembly when electrical power is provided at said socket and said bulb assembly is seated in said light socket, each socket including a series-connected electrically conductive shunt having a resistive element, said series connected electrically conductive shunt and resistive element bridging said at least two leads within said socket when said bulb assembly is not seated in said socket, said bulb assembly disengaging said bridging when said bulb assembly is seated in said socket, said electrical power flowing through said series-connected resistive element and said electrically conductive shunt when said bulb is not seated in said socket, said resistive element being matched to a resistive characteristic of said bulb assembly within said light socket, passing current through said light string and illuminating said plurality of light sources within said bulb assemblies, said current passing through said light bulb assemblies until one bulb assembly fails;

removing said failed bulb assembly;

passing current through said series-connected resistive element and said electrically conductive shunt within said light socket containing said failed bulb assembly;

maintaining a consistent illumination level of said bulb assemblies within said light string;

replacing said failed bulb assembly while maintaining said consistent illumination of said bulb assemblies within said light string; and removing said passed current through said series-connected resistive element and said electrically conductive shunt within said light socket containing said previously failed bulb assembly.

12. The method of claim 11 wherein said step of removing said filed bulb assembly includes the step of bridging said at least two leads within said socket with said series connected electrically conductive shunt and resistive element.

13. The method of claim 11 wherein said step of replacing said failed bulb assembly includes the step of disengaging said at least two leads within said socket with said series connected electrically conductive shunt and resistive when said bulb assembly is seated in said socket.

* * * * *